US007270152B2

(12) United States Patent
Ueda et al.

(10) Patent No.: US 7,270,152 B2
(45) Date of Patent: Sep. 18, 2007

(54) INDUSTRIAL TWO-LAYER FABRIC

(75) Inventors: Ikuo Ueda, Shizuoka (JP); Hiroyuki Nagura, Shizuoka (JP)

(73) Assignee: Nippon Filcon Co., Ltd., Tokyo (JP)

( * ) Notice: Subject to any disclaimer, the term of this patent is extended or adjusted under 35 U.S.C. 154(b) by 54 days.

(21) Appl. No.: 11/270,509

(22) Filed: Nov. 10, 2005

(65) Prior Publication Data

US 2006/0102244 A1 May 18, 2006

(30) Foreign Application Priority Data

Nov. 17, 2004 (JP) ..... 2004-333080

(51) Int. Cl.
*D21F 7/08* (2006.01)
*D03D 25/00* (2006.01)

(52) U.S. Cl. ..... 139/383 A; 162/358.2

(58) Field of Classification Search ..... 139/383 A; 162/358.2, 900, 902
See application file for complete search history.

(56) References Cited

U.S. PATENT DOCUMENTS 4,729,412 A * 3/1988 Bugge ..... 139/383 A
4,995,428 A * 2/1991 Tate et al. ..... 139/383 A
5,022,441 A * 6/1991 Tate et al. ..... 139/383 A
5,103,875 A * 4/1992 Tate et al. ..... 139/383 A
5,379,808 A * 1/1995 Chiu ..... 139/383 A
5,429,686 A * 7/1995 Chiu et al. ..... 139/383 A
5,482,567 A * 1/1996 Barreto ..... 139/383 A
5,544,678 A * 8/1996 Barrett ..... 139/383 A
5,829,489 A * 11/1998 Kuji ..... 139/383 A
6,189,577 B1 * 2/2001 Lee ..... 139/383 A
6,510,873 B2 * 1/2003 Nagura ..... 139/383 A
6,860,299 B2 3/2005 Kuji
7,059,357 B2 * 6/2006 Ward ..... 139/348

(Continued)

FOREIGN PATENT DOCUMENTS

EA 1 365 066 A1 11/2003

(Continued)

OTHER PUBLICATIONS

English translation of Official Action concerning Patent Application No. 20061740 dated Jun. 22, 2006.

(Continued)

*Primary Examiner*—Robert H Muromoto
(74) *Attorney, Agent, or Firm*—Rader, Fishman & Grauer PLLC

(57) ABSTRACT

An industrial two-layer fabric obtained by alternately arranging, on an upper surface side thereof, (a) a warp complete design made of a design in which a warp passes over one upper surface side weft and then passes under one upper surface side weft, and any one of the following warp complete designs of: (b) a warp complete design made of a design in which a warp passes over two upper surface side wefts and then passes under two upper surface side wefts, (c) a warp complete design made of a design in which a warp passes over one upper surface side weft and then passes under three upper surface side wefts, (d) a warp complete design made of a design in which a warp passes over three upper surface side wefts and then passes under one upper surface side weft, and others.

10 Claims, 11 Drawing Sheets

U.S. PATENT DOCUMENTS

| | | | | |
|---|---|---|---|---|
| 7,108,019 | B2 * | 9/2006 | Nagura et al. | 139/383 A |
| 2004/0154683 | A1 * | 8/2004 | Majaury et al. | 139/383 A |
| 2004/0182465 | A1 * | 9/2004 | Ward | 139/383 A |
| 2006/0048838 | A1 * | 3/2006 | Takimoto | 139/383 A |
| 2006/0096653 | A1 * | 5/2006 | Eagles | 139/383 A |
| 2006/0112999 | A1 * | 6/2006 | Nagura et al. | 139/383 A |
| 2006/0162804 | A1 * | 7/2006 | Heger et al. | 139/383 A |
| 2006/0219312 | A1 * | 10/2006 | Hay et al. | 139/383 A |
| 2006/0278294 | A1 * | 12/2006 | Quigley | 139/383 A |
| 2006/0278295 | A1 * | 12/2006 | Ueda et al. | 139/383 A |

FOREIGN PATENT DOCUMENTS

| | | | |
|---|---|---|---|
| EP | 0 345 643 | B1 | 12/1989 |
| EP | 1 630 271 | A2 | 3/2006 |
| NO | 304193 | B1 | 9/1996 |
| NO | 314947 | B1 | 6/2003 |
| NO | 317618 | B1 | 11/2004 |
| WO | WO-2004/038094 | A1 | 5/2004 |

OTHER PUBLICATIONS

English translation of Official Action concerning Patent Application No. 20061730 dated Jun. 22, 2006.

English translation of Office Action concerning Patent Application No. 20061739 dated Jun. 23, 2006.

* cited by examiner 1 2

1

2

INDUSTRIAL TWO-LAYER FABRIC

TECHNICAL FIELD

The present invention relates to an industrial fabric comprising warp binding yarns and capable of satisfying all the requirements necessary for industrial fabrics such as surface property, fiber supporting property, rigidity, running stability and water drainage property.

BACKGROUND OF THE INVENTION

Fabrics obtained by weaving warps and wefts have conventionally been used widely as an industrial fabric. They are, for example, used in various fields including papermaking wires, conveyor belts and filter cloths and are required to have fabric properties suited for the intended use or using environment. Of such fabrics, a papermaking wire used in a papermaking step for removing water from raw materials by making use of the network of the fabric must satisfy a severe demand. There is therefore a demand for the development of fabrics which do not transfer a wire mark of the fabric and therefore have excellent surface property, have enough rigidity and therefore are usable desirably even under severe environments, or are capable of maintaining conditions necessary for making good paper for a prolonged period of time. In addition, fiber supporting property, improvement in a papermaking yield, good water drainage property, wear resistance, dimensional stability and running stability are demanded. In recent years, owing to the speed-up of a papermaking machine, requirements for papermaking wires become severe further.

Since most of the demands for industrial fabrics and solutions thereof can be understood if papermaking fabrics on which the most severe demand is imposed among industrial fabrics will be described, the present invention will hereinafter be described by using the papermaking fabric as a representative example.

For papermaking fabrics, excellent surface property not permitting transfer of wire marks of the fabric to paper, fiber supporting property for supporting fine fibers, running stability ensuring stable running until the final using stage and rigidity are very important. Research on the design or constitution of the fabric capable of satisfying the above-described properties is proceeding. Recently, two-layer fabrics using a warp binding yarn which is woven with both an upper surface side weft and a lower surface side weft to form an upper surface side surface and a lower surface side surface and at the same time, has a binding function have come to be used. A two-layer fabric using a warp binding yarn is also disclosed in Japanese Patent Laid-Open Publication No. 2004-68168. This fabric does not use an additional binding yarn. Since it has a design in which a warp forming a surface passes over one upper surface side weft and then passes under three upper surface side wefts, the count of wefts can be increased, leading to the formation of a dense surface. As a result, the fabric has improved surface property and fiber supporting property. As described above, however, this fabric has a design in which a warp forming a surface passes over one upper surface side weft and then passes under three upper surface side wefts so that the number of knuckles which are intersections of warps and wefts is small and therefore the fabric has poor rigidity. Its running stability sometimes gradually deteriorates. A fabric developed with a view to improving its rigidity is disclosed in Japanese Patent Laid-Open Publication No. 2004-52188. By employing a plain weave design for the upper surface side according to this invention, the resulting fabric is able to have improved surface property, fiber supporting property and rigidity.

SUMMARY OF THE INVENTION

This fabric is however accompanied with such a drawback that owing to an increase in the number of knuckles, it is difficult to increase the count of wefts and form a dense surface. In addition, although the plain weave fabric has many fiber supporting spots, it is poor in water drainage property and air permeability because there is not an enough water drainage space. Industrial fabrics capable of satisfying all the necessary properties such as surface property, fiber supporting property, rigidity, running stability and water drainage property have not yet been developed.

An object of the present invention is to provide an industrial two-layer fabric capable of satisfying all the properties necessary for industrial fabrics such as surface property, fiber supporting property, rigidity, running stability and water drainage property.

An industrial two-layer fabric of the present invention comprises pairs of an upper surface side warp and a lower surface side warp arranged vertically, upper surface side wefts, lower surface side wefts, and warp binding yarns woven with the wefts to form a portion of an upper surface side surface design and a portion of a lower surface side surface design. The industrial two-layer fabric has an upper surface side surface formed by alternately arranging (a) a warp complete design made of a design in which one warp passes over one upper surface side weft and then passes under one upper surface side weft, and any one of the following warp complete designs (b) to (i): (b) a warp complete design made of a design in which one warp passes over two upper surface side wefts and then passes under two upper surface side wefts, (c) a warp complete design made of a design in which one warp passes over one upper surface side weft and then passes under three upper surface side wefts, (d) a warp complete design made of a design in which one warp passes over three upper surface side wefts and then passes under one upper surface side weft, (e) a warp complete design made of a design in which one warp passes over three upper surface side wefts and then passes under three upper surface side wefts, (f) a warp complete design made of a design in which one warp passes over two upper surface side wefts and then passes under four upper surface side wefts, (g) a warp complete design made of a design in which one warp passes over four upper surface side wefts and then passes under two upper surface side wefts, (h) a warp complete design made of a design in which one warp passes over one upper surface side weft and then passes under five upper surface side wefts, and (i) a warp complete design made of a design in which one warp passes over five upper surface side wefts and then passes under one upper surface side weft.

The complete design constituting the fabric may be a 16-shaft one having 16 warps or a 24-shaft one having 24 warps. The upper surface side surface design may be made of one or two weft complete designs.

The industrial two-layer fabric according to the present invention comprises pairs of an upper surface side warp and a lower surface side warp arranged vertically, and warp binding yarns woven with upper surface side wefts and lower surface side wefts form a portion of an upper surface side surface design and a portion of a lower surface side surface design. Since the fabric has an upper surface side surface composed of a complete design in which two warp complete designs are arranged alternately, it has improved surface property, fiber supporting property, rigidity, running stability and water drainage property.

DETAILED DESCRIPTION OF THE INVENTION

Figure 1:
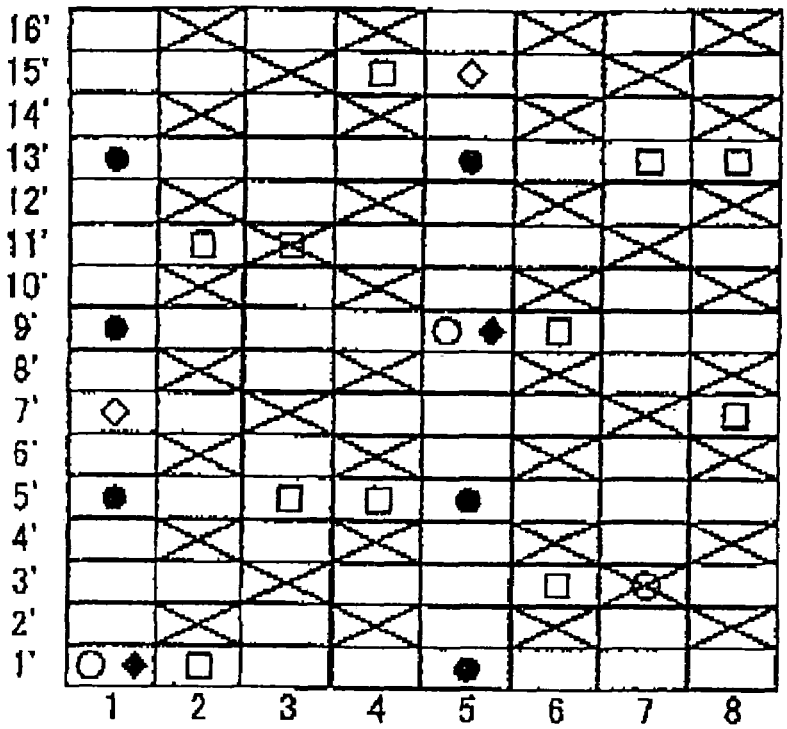
FIG. 1 is a design diagram of an industrial two-layer fabric according to Example 1 of the present invention.

The industrial fabric according to the present invention is an industrial two-layer fabric comprising pairs of an upper surface side warp and a lower surface side warp arranged vertically, and warp binding yarns woven with upper surface side wefts and lower surface side wefts to form a portion of an upper surface side surface design and a portion of a lower surface side surface design. This fabric has an upper surface side surface composed of a complete design in which two warp complete designs are arranged alternately.

The term "complete design" of a fabric means a minimum unit of a design constituting the fabric and the fabric is formed by repeating this complete design longitudinally and latitudinally. The term "warp complete design" means a warp design constituting the complete design of the fabric, while the term "weft complete design" means a weft design forming the complete design of the fabric. In this specification, when a warp binding yarn forms the lower surface side surface, it may be expressed as a lower surface wide warp.

In the present invention, the upper surface side is composed of two warp complete designs which are arranged alternately. Described specifically, one of the two complete designs is (a) a warp complete design in which one warp passes over one upper surface side weft and then passes under one upper surface side weft (which will hereinafter be called "plain weave warp complete design". The other one is any one of the following warp complete designs (which will hereinafter be called "another warp complete design"): (b) a warp complete design in which one warp passes over two upper surface side wefts and then passes under two upper surface side wefts, (c) a warp complete design in which one warp passes over one upper surface side weft and then passes under three upper surface side wefts, (d) a warp complete design in which one warp passes over three upper surface side wefts and then passes under one upper surface side weft, (e) a warp complete design in which one warp passes over three upper surface side wefts and then passes under three upper surface side wefts, (f) a warp complete design in which one warp passes over two upper surface side wefts and then passes under four upper surface side wefts, (g) a warp complete design in which one warp passes over four upper surface side wefts and then passes under two upper surface side wefts, (h) a warp complete design in which one warp passes over one upper surface side weft and then passes under five upper surface side wefts, and (i) a warp complete design in which one warp passes over five upper surface side wefts and then passes under one upper surface side weft. The design greater than 1/5 or 5/1, for example, 1/9 or 9/1, or 1/7 or 7/1 is not preferred, because a float between two adjacent warps or wefts becomes too large and diagonal rigidity lowers. The upper surface side complete design is formed by alternately arranging these two warp complete designs. In the present invention, the upper surface side weft is composed of one or two complete designs, according to which the complete design must be considered.

The warp complete design can be selected in accordance with the number of shafts or using purpose of the fabric. For a 16-shaft fabric, a warp complete design in which warp passes over two upper surface side wefts and then passes under two upper surface side wefts, a warp complete design in which a warp passes over one upper surface side weft and then passes under three upper surface side wefts or a warp complete design in which one warp passes over three upper surface side wefts and then passes under one upper surface side weft is preferred. For a 24-shaft fabric, as well as the above-described warp complete designs, a warp complete design in which one warp passes over three upper surface side wefts and then passes under three upper surface side wefts, a warp complete design in which a warp passes over two upper surface side wefts and then passes under four upper surface side wefts, a warp complete design in which one warp passes over four upper surface side wefts and then passes under two upper surface side wefts, a warp complete design in which a warp passes over one upper surface side weft and then passes under five upper surface side wefts, a warp complete design in which one warp passes over five upper surface side wefts and then passes under one upper surface side wefts is preferred. The warp complete design may be selected depending on the using purpose or the number of shafts. A 16-shaft fabric is suited for the applications needing rigidity, because the number of intersections between warps and wefts is greater. When formation of a weft long crimp on the upper surface side surface is required, a warp complete design in which one warp passes over one upper surface side weft and then passes under three upper surface side wefts or a warp complete design in which one warp passes over one upper surface side weft and then passes under five upper surface side wefts is preferred. Such fabrics are however not suited for the applications requiring rigidity, because the number of knuckles of warps and wefts is small and diagonal rigidity is especially low.

Existence of two warp complete designs on the upper surface side surface is effective for exhibition of their respective functions and compensation for deficiencies which these complete designs have. A fabric having an upper surface side surface composed of a plain weave warp complete design alone is excellent in surface property, fiber supporting property and rigidity, but the upper surface side surface is not so dense as that of a fabric with another design because the count cannot be increased. In addition, the number of knuckles formed at the intersections of warps and wefts is so large that water drainage space is filled therewith, leading to poor air permeability and water drainage property.

A fabric having an upper surface side surface composed of the another warp complete design alone, for example, a warp complete design in which a warp passes over one upper surface side weft and then passes under three successive upper surface side wefts is excellent in air permeability and water drainage property because the number of knuckles of warps and wefts is smaller than that of the plain weave warp complete design and a space is formed in the diagonal direction. The count of wefts can be made greater than that of a plain weave fabric equal in yarn diameter. The fabric however is inferior in rigidity owing to a decrease in the number of knuckles. In addition, such a fabric has twill so that stretching in a warp direction upon use inevitably stretches the fabric in one direction owing to a difference in elongation. The diagonal deformation or dimensional change of the fabric sometimes prevents running of the fabric uniformly on both sides.

As described above, a plain weave warp complete design and another warp complete design each has advantages and disadvantages. The fabric of the present invention has these two warp complete designs arranged alternately to develop their advantages while making up for their disadvantages so that it is suited as an industrial fabric.

The fabric of the present invention is composed of upper surface side warps, upper surface side wefts, lower surface side warps, lower surface side wefts and warp binding yarns. The upper surface side warps and upper surface side wefts are woven together to form an upper surface side surface, while lower surface side warps and lower surface side wefts are woven together to form a lower surface side surface. An upper surface side warp and a lower surface side warp are arranged vertically and form a pair. A warp binding yarn is woven with both of upper surface side weft and lower surface side weft and form a portion of the upper surface side surface and a portion of the lower surface side surface, and at the same time binds the upper surface side layer and the lower surface side layer together.

In the present invention, a warp binding yarn is not disposed singly but (1) two warp binding yarns are used as a pair (2) it forms a pair with a upper surface side warp or (3) it forms a pair with a lower surface side warp. In such a manner, warp binding yarns are always disposed as a pair. The two warps constituting any one of the pairs (1) to (3) cooperatively function as one warp constituting the upper surface side warp complete design and as one warp constituting the lower surface side warp complete design, respectively.

In the pair (1) of two warp binding yarns, they may have the same design or different design. Any warp binding yarns can be used insofar as they are woven with an upper surface side weft and a lower surface side weft to form a portion of the upper surface side surface design and a portion of the lower surface side surface design. Warp binding yarns forming a pair appear alternately on the upper surface side surface and these two yarns cooperatively function as one warp constituting the upper surface side complete design. For example, two warp binding yarns appear alternately on the upper surface side surface and they are woven with upper wefts which are different each other to form a plain weave warp complete design corresponding to one warp; or two warp binding yarns appear alternately on the upper surface side surface and form a warp complete design made of a design in which each of them passes over one upper surface side weft surface and then passes under three successive upper surface side wefts. On the lower surface side surface, two warp binding yarns each passes under at least one lower surface side weft to form the lower surface side design. In particular, one of warp binding yarns forming a pair is woven with an upper surface side weft, under which the other warp binding yarn is woven with at least one lower surface side wefts and at the same time, the one of warp binding yarns forming a pair is woven with at least one lower surface side weft, under which the other warp binding yarn is woven with at least one upper surface side weft. It is preferred that a pair of warp binding yarns complement each other to form the upper surface side surface design and the lower surface side surface design, because it prevents the surface designs on both sides from being destroyed.

In the pair (2) of an upper surface side warp and a warp binding yarn, the warp binding yarn is, similar to (1), woven with each of an upper surface side weft and a lower surface side weft. The warp binding yarn and upper surface side warp appear alternately on the upper surface side surface and they cooperatively function as one warp constituting the upper surface side complete design. For example, one warp binding yarn and one upper surface side warp appear alternately on the upper surface side surface and form a plain weave warp complete design; or they alternately appear on the upper surface side surface and form a warp complete design in which each of them passes over two upper surface side wefts and then passes under two upper surface side wefts. On the lower surface side surface, a warp binding yarn passes under at least one lower surface side weft to form a lower surface side design.

In the pair (3) of a lower surface side warp and a warp binding yarn, the warp binding yarn is, similar to (1) or (2), woven with each of an upper surface side weft and a lower surface side weft. On the upper surface side surface, a warp binding yarn is woven with an upper surface side weft and functions as one warp constituting the upper surface side complete design. For example, one warp binding yarn forms, on the upper surface side surface, a warp complete design made of a design in which one warp binding yarn passes over one upper surface side weft and then passes under three upper surface side wefts. On the lower surface side surface, a warp binding yarn passes under at least one lower surface side weft, and this warp binding yarn and the lower surface side warp, as a pair, appear alternately on the lower surface side surface and cooperatively form the lower surface side warp design.

Warp binding yarns are used in such three patterns. Any patterns can be arranged freely, and no particular limitation is imposed on the arrangement ratio or arrangement order. For example, a pair of two warp binding yarns and a pair of an upper surface side warp and lower surface side warp may be arranged alternately, that is, at 1:1. The arrangement ratio may be changed to 1:3, 2:2, 1:5 or 3:1. A warp binding yarn may be used as a warp forming a plain weave warp complete design on the upper surface side surface or a warp binding yarn may be used as a warp forming another warp complete design. It is needless to say that the above-described two pairs may be arranged in a complete design of one fabric.

Although there is no particular limitation is imposed on the lower surface side surface design, a design excellent in wear resistance such as a design having a lower surface side weft long crimp on the lower surface side surface is preferred. Examples of such a design include a design in which a lower surface side weft is woven from the lower surface side by two adjacent warps and in the other portion, passes under six successive lower surface side warps; and a design in which a lower surface side weft passes over one lower surface side warp, passes under one lower surface side warp, passes over one lower surface side warp and then passes under five successive lower surface side warps. Two adjacent lower surface side warps simultaneously weave one lower surface side weft from the lower surface side, whereby the lower surface side weft forms a weft long crimp corresponding to a plurality of lower surface side warps on the lower surface side surface. At the same time, by forming a portion where a lower surface side warp passes under a lower surface side weft alternately with right-hand and left-hand lower surface side warps which are adjacent to the lower surface side warp, the lower surface side warp is brought into contact with these two right-hand and left hand lower surface side warps alternately to form a zigzag arrangement design. As a result, the fabric is able to have improved water drainage property and diagonal rigidity.

Yarns arranged in the crosswise direction are upper surface side wefts and lower surface side wefts and they are vertically arranged. Upper surface side wefts and lower surface side wefts may be arranged at an equal ratio, but a fabric has improved surface property and fiber supporting property when the number of upper surface side wefts is greater than that of lower surface side wefts. For example, upper surface side wefts and lower surface side wefts are arranged at a ratio of 2:1 or 3:1.

Although a yarn to be used in the present invention may be selected depending on its using purpose, examples of it include, in addition to monofilaments, multifilaments, spun yarns, finished yarns subjected to crimping or bulking such as so-called textured yarn, bulky yarn and stretch yarn and yarns obtained by intertwining them. As the cross-section of the yarn, not only circular form but also square or short form such as stellar form, or elliptical or hollow form can be used. The material of the yarn can be selected freely and usable examples of it include polyester, polyamide, polyphenylene sulfide, polyvinylidene fluoride, polypropylene, aramid, polyether ether ketone, polyethylene naphthalate, polytetrafluoroethylene, cotton, wool and metal. Of course, yarns obtained using copolymers or incorporating or mixing the above-described material with a substance selected depending on the intended purpose may be used.

As upper surface side warps, lower surface side warps, warp binding yarns and upper surface side wefts of a papermaking wire, use of a polyester monofilament having rigidity and excellent dimensional stability is usually preferred. As lower surface side wefts which need wear resistance, those obtained by combined weaving of polyester monofilaments and polyamide monofilaments while arranging them alternately are preferred, because they have improved wear resistance while having rigidity.

With regards to the diameter of yarns constituting a fabric, it is recommended to use those having a relatively small diameter for upper surface side warps and upper surface side wefts which constitute the upper surface side surface. Use of them enables to form a dense surface. An auxiliary weft having a smaller diameter than that of an upper surface side weft may be disposed adjacent to the upper surface side weft. Particularly when there exist two weft complete designs formed on the upper surface side surface, it is recommended to use an auxiliary weft for the yarn on the formation side of a long crimp which passes over a plurality of warps on the upper surface side and to use an upper surface side weft for the other yarn. Arrangement of an auxiliary weft is effective for improving fiber supporting property in a weft direction.

Yarns of a relatively great diameter are suited as lower surface side warps and lower surface side wefts which are responsible for wear resistance of the fabric. When a priority is given to the surface property on the upper surface side, warp binding yarns almost equal in diameter to upper surface side warps are suited, while when a priority is given to the wear resistance, yarns almost equal in diameter to lower surface side warps and having a relatively great diameter are suited. Warp binding yarns may be made equal in diameter to lower surface side warps owing to weaving reasons. Diameter of yarns or material quality can be selected as needed depending on the using purpose or intended use.

Embodiments of the present invention will next be described based on some examples with reference to accompanying drawings.

Figures 13A, 13B:
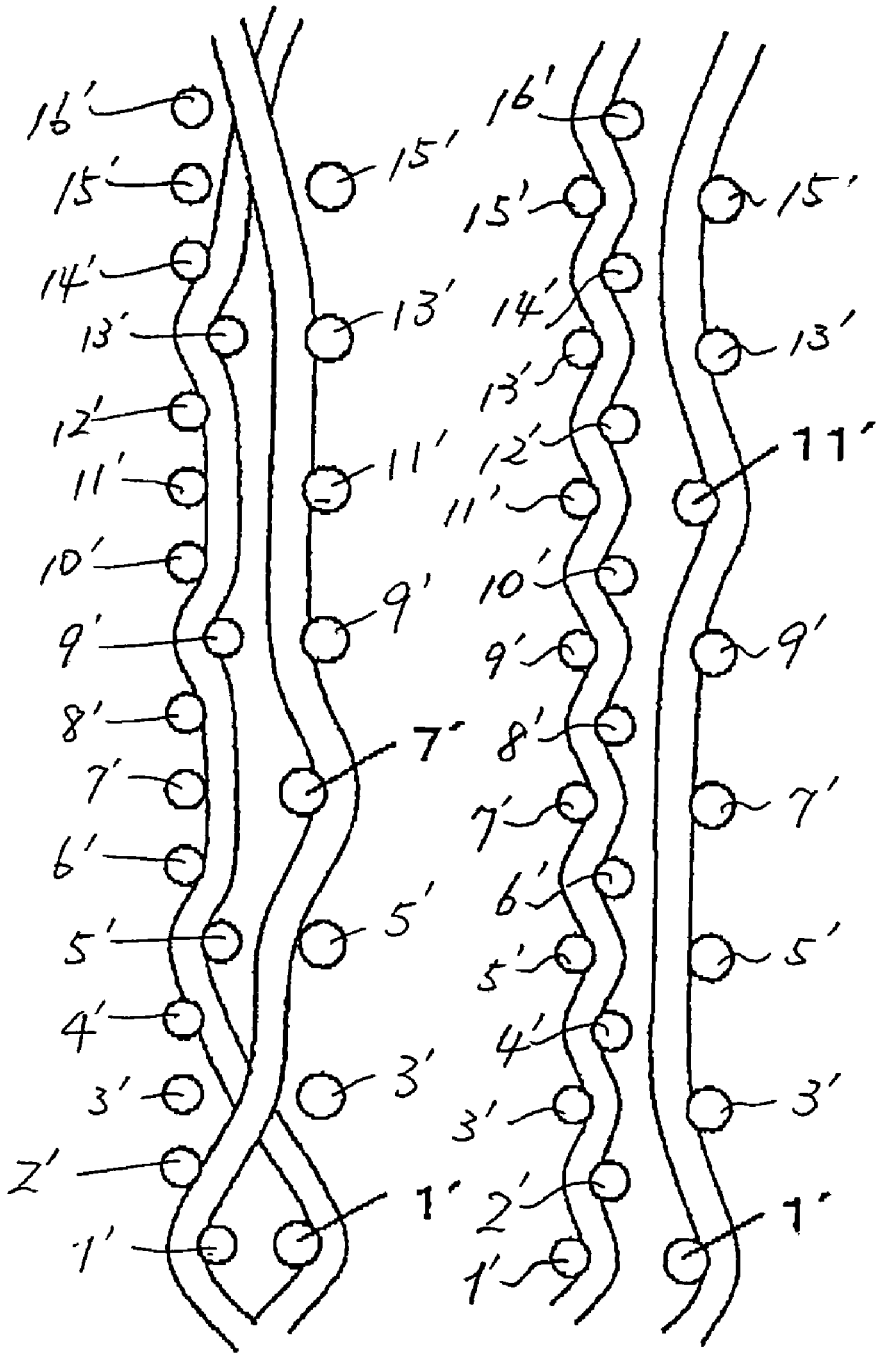
FIGS. 13A and 13B are cross-sectional views taken along warps 1 and 2 of FIG. 1 of the present invention, respectively.
Figure 14A:
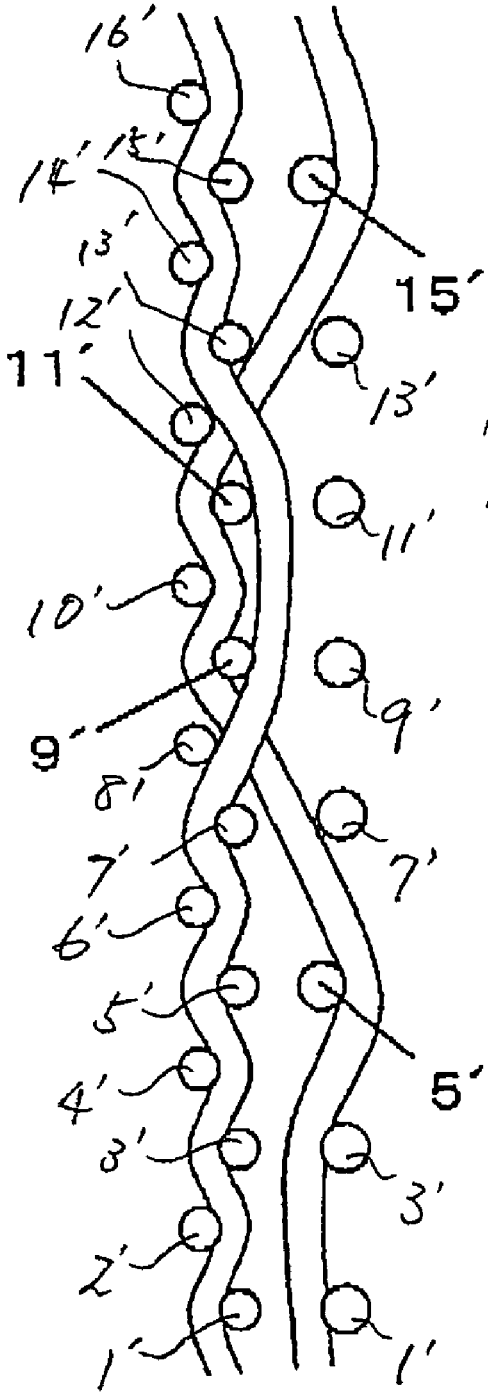
FIGS. 14A and 14B are cross-sectional views taken along warps 1 and 2 of FIG. 8 of the present invention, respectively.
Figure 14B:
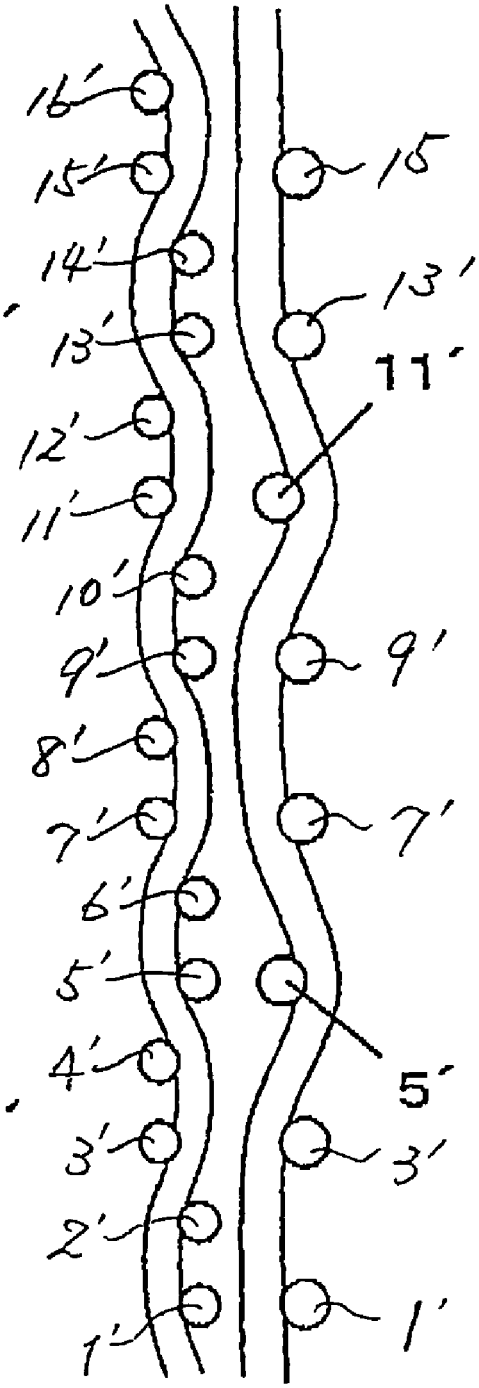
Figures 15A, 15B:
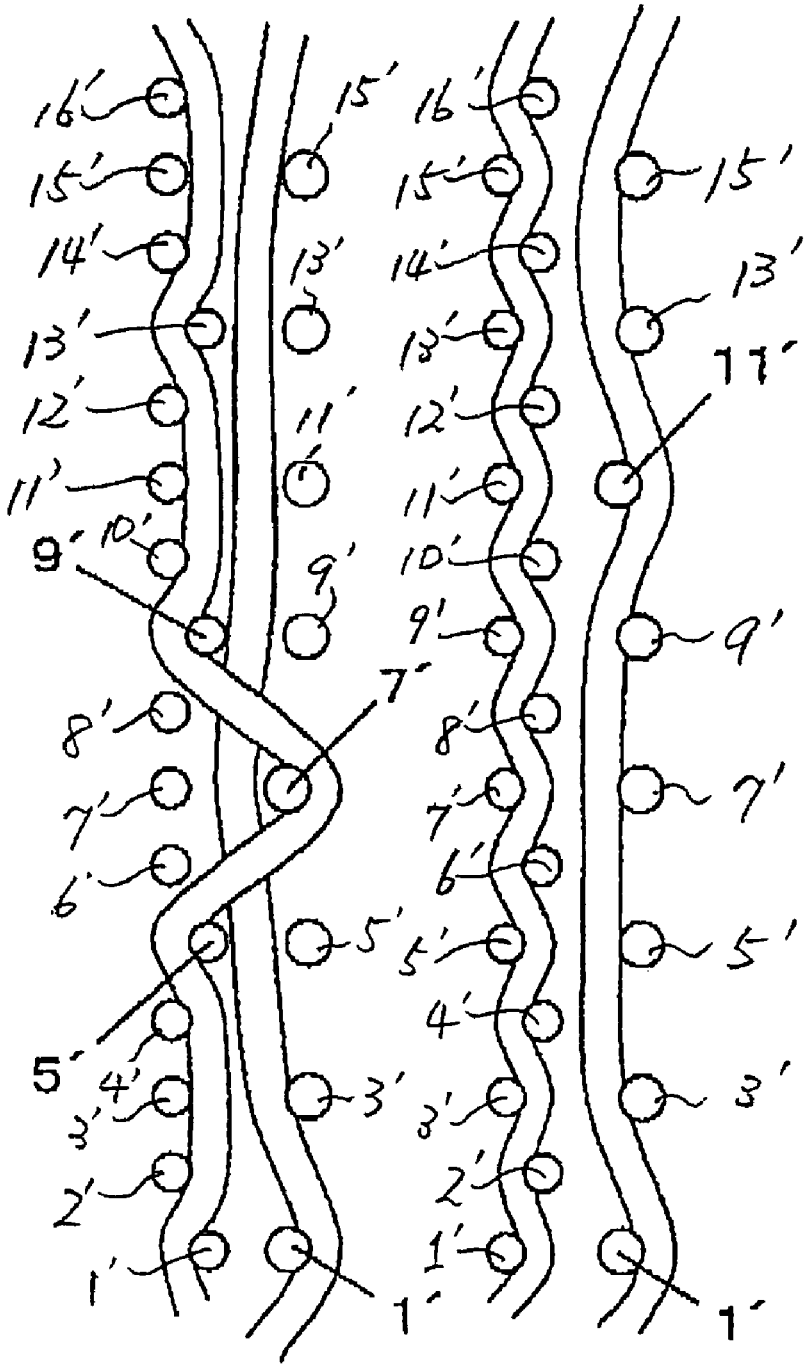
FIGS. 15A and 15B are cross-sectional views taken along warps 1 and 2 of FIG. 9 of the present invention, respectively.

FIGS. 1 to 12 are design diagrams illustrating the complete designs of the examples of the present invention. The term "complete design" as used herein means a minimum recurring unit of a fabric design and a whole fabric design is formed by connecting this complete design longitudinally and latitudinally. FIGS. 13A and 13B are cross-sectional views taken along warps 1 and 2 of FIG. 1 respectively; FIGS. 14A and 14B are cross-sectional views taken along warps 1 and 2 of FIG. 8, respectively; and FIGS. 15A and 15B are cross-sectional views taken along warps 1 and 2 of FIG. 9, respectively.

In the design diagrams, warps are indicated by Arabic numerals, for example 1, 2 and 3, and wefts are indicated by Arabic numerals with a prime, for example, 1', 2' and 3'. Warps are any one of pairs of an upper surface side warp and a lower surface side warp arranged vertically, pairs of two warp binding yarns, pairs of an upper surface side warp and a warp binding yarn, and pairs of a lower surface side warp and a warp binding yarn. At least one of these pairs including a warp binding yarn is arranged in the complete design. With regards to wefts, some portions are composed of an upper surface side weft alone and some portions are composed of an upper surface side weft and a lower surface side weft arranged vertically. An upper surface side weft may be substituted with an auxiliary weft smaller in diameter than the upper surface side weft.

In the diagram, a mark "x" means that an upper surface side warp lies over an upper surface side weft, a mark "□" indicates that a lower surface side warp lies under a lower surface side weft. Marks "◆" and • indicate that a warp binding yarn lies over an upper surface side weft, while marks "◇" and "○" indicate that a warp binding yarn lies under a lower surface side weft.

EXAMPLES

Example 1

In the design diagram of FIG. 1, indicated at numerals 2, 3, 4, 6, 7 and 8 are pairs of an upper surface side warp and a lower surface side warp arranged vertically, while indicated at numerals 1 and 5 are pairs of warp binding yarns.

Indicated at 1', 2', and 3' to 16' are wefts and an upper surface side weft and a lower surface side weft are arranged vertically. Upper surface side wefts and lower surface side wefts are arranged at 2:1 and they are arranged vertically with the lower surface side wefts being laid under odd-numbered upper surface side wefts.

As is apparent from the cross-sectional views of FIGS. 13A and 13B taken along warps 1 and 2, the fabric of Example 1 is a 16-shaft two-layer fabric obtained by alternately arranging, on the upper surface side surface of the fabric, a warp complete design obtained by repeating a design in which a warp passes over one upper surface side weft and then passes under one upper surface side weft and another warp complete design obtained by repeating a design in which a warp passes over one upper surface side weft and then passes under three upper surface side wefts. Pairs of warp binding yarns and pairs of an upper surface side warp and a lower surface side warp are arranged at a ratio of 1:3.

In each of the pairs of warp binding yarns, one warp binding yarn is woven with an upper surface side weft to form an upper surface side design, while the other warp binding yarn is woven with one lower surface side weft to form a lower surface side design. In other words, two warp binding yarns alternately form a portion of the upper surface side surface design on the upper surface side surface, while two warp binding yarns alternately form a portion of the lower surface side surface design on the lower surface side surface.

One warp binding yarn has a design in which it passes over one upper surface side weft, passes between three upper and lower surface side wefts, passes over one upper surface side weft, passes between three upper and lower surface side wefts, passes over one upper surface side weft, passes between three upper and lower surface side wefts, passes under one lower surface side weft, and passes between three upper and lower surface side wefts. The other warp binding yarn has a design in which it passes over one upper surface side weft, passes between five upper and lower surface side wefts, passes under one lower surface side weft, and passes between nine upper and lower surface side wefts. These designs are used in combination and a warp complete design is formed by repeating a design in which a warp passes over one upper surface side weft and then passes under three upper surface side wefts. Also on the lower surface side, a warp forming the lower surface side has a design in which it passes under one lower surface side weft, passes over two lower surface side wefts, passes under one lower surface side weft and passes over four lower surface side wefts. Warp binding yarns forming a pair have different designs each other in this example, but they may have the same design.

Use of a pair of warp binding yarns enables to strongly bind the upper surface side fabric and the lower surface side fabric without destroying the upper surface side surface design and the lower surface side surface design. In addition, the count can be increased because of absence of additional binding yarns.

Since there exist two warp complete designs on the upper surface side surface, the resulting fabric can display functions of these two warp complete designs and moreover, can make up for defects of these warp complete designs. In short, the fabric thus obtained has excellent surface property, fiber supporting property, rigidity, air permeability, and water drainage property and is able to have a dense upper surface side surface because the count can be increased.

Upper surface side wefts have two designs, that is, a design in which it passes over three upper surface side warps and then passes under one upper surface side warp and a design in which it passes over one upper surface side warp and then passes under one upper surface side warp. These designs are alternately arranged.

On the lower surface side, a lower surface side weft has a design in which it passes over two adjacent warps and then passes under six warps to form a weft long crimp on the lower surface side. By employing such a design, the resulting fabric has excellent wear resistance. A lower surface side warp forms a zigzag arrangement while being brought into contact alternately with right-hand and left-hand lower surface side warps which are adjacent thereto. The upper surface side warp and lower surface side warp are therefore not overlapped each other. Owing to variably-sized and variably-shaped water drainage spaces thus formed, the above-described design is effective for preventing drastic dehydration. For example, a lower surface side warp 3 and a lower surface side warp 4 which are adjacent each other are woven with a lower surface side weft 5 simultaneously so that the lower surface side warp 3 approaches the lower surface side warp 4 at the position where the lower surface side warp 3 is woven with the lower surface side weft 5'. A lower surface side warp 2 and a lower surface side warp 3 which are adjacent each other are woven with a lower surface side weft 11' simultaneously so that the lower surface side warp 3 approaches the lower surface side warp 2 at the position where the lower surface side warp 3 is woven with the lower surface side weft 11'. The lower surface side warp 3 therefore winds its way from side to side and forms a zigzag arrangement. This also applies to lower surface side warps and warp binding yarns and is effective for preventing dehydration marks.

Example 2

Figure 2:
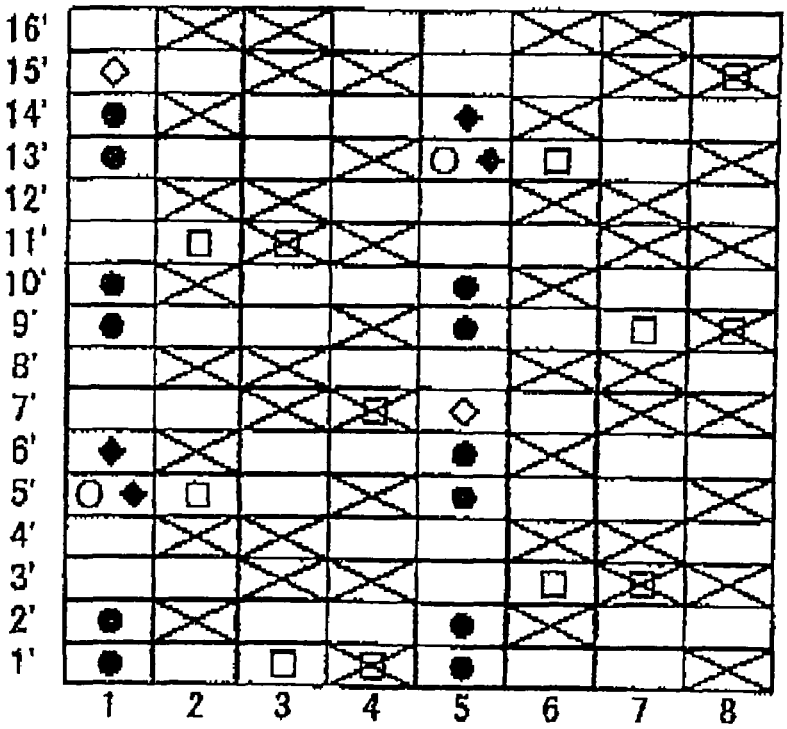
FIG. 2 is a design diagram of an industrial two-layer fabric according to Example 2 of the present invention.

Another example of the fabric according to the present invention is shown in FIG. 2. This fabric is a 16-shaft two-layer fabric having, on the upper surface side surface thereof, alternately arranged two warp complete designs, that is, a warp complete design obtained by repeating a design in which a warp passes over one upper surface side weft and then passes under one upper surface side weft and a warp complete design obtained by repeating a design in which a warp passes over two upper surface side wefts and then passes under two upper surface side wefts. Pairs of warp binding yarns and pair of an upper surface side warp and a lower surface side warp are arranged at a ratio of 1:3. The pairs of warp binding yarns form, on the upper surface side surface, a warp complete design obtained by repeating a design in which it passes over two upper surface side wefts and then passes under two upper surface side wefts.

This example is different from Example 1 in a warp complete design formed on the upper surface side surface. Although this example is similar to Example 1 in a warp complete design in which a warp passes over one upper surface side weft and then passes under one upper surface side weft, it is different in another warp complete design. In this Example, that obtained by repeating a design in which a warp passes over two upper surface side wefts and then passes under two upper surface side wefts is employed as the another design. Even if an upper surface side surface design different from that of Example 1 is employed, a fabric excellent in surface property, fiber supporting property, rigidity, air permeability and water drainage property and having an upper surface side surface densified by an increase in the count can be obtained. Such a design can be adopted for warp binding yarns insofar as two warp binding yarns cooperatively form the upper surface side design and lower surface side surface design and bind the upper surface side fabric and the lower surface side fabric together.

As an upper surface side weft design, one weft design in which a weft passes over two warps and then passes under two warps is arranged in repetition.

Example 3

Figure 3:
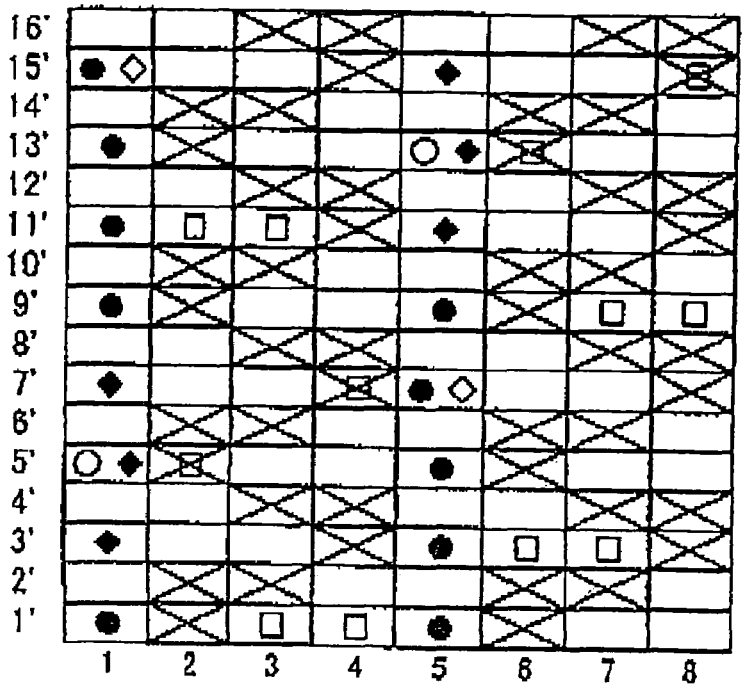
FIG. 3 is a design diagram of an industrial two-layer fabric according to Example 3 of the present invention.

A further example of the fabric according to the present invention is illustrated in FIG. 3. The fabric of this example has a similar upper surface side surface design to that of Example 2 except that pairs of warp binding yarn have, on the upper surface side surface, a warp complete design obtained by repeating a design in which a warp binding yarn passes over one upper surface side weft and then passes under one upper surface side weft. Even by this example, a fabric excellent in surface property, fiber supporting property, rigidity, air permeability and water drainage property and having an upper surface side surface densified by an increase in the count can be obtained.

Example 4

Figure 4:
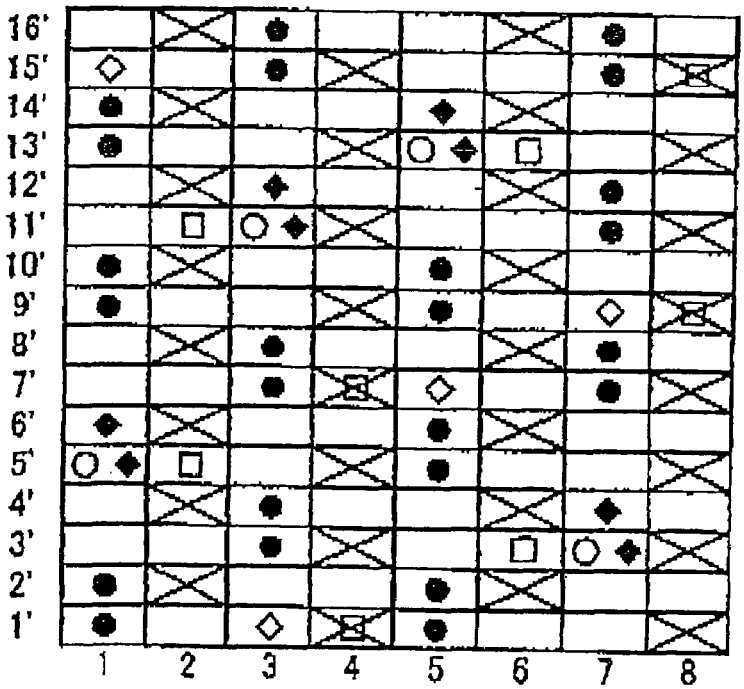
FIG. 4 is a design diagram of an industrial two-layer fabric according to Example 4 of the present invention.

A still further example of the fabric according to the present invention is illustrated in FIG. 4. In this fabric, pairs of warp binding yarns and pairs of an upper surface side warp and a lower surface side warp are arranged at a ratio of 1:1. The design of warp binding yarns is similar to that in Example 2. Pairs of warp binding yarns always form, on the upper surface side surface, a warp complete design obtained by repeating a design in which a warp binding yarn passes over two upper surface side wefts and then passes under two upper surface side wefts. Upper surface side warps form a warp complete design obtained by repeating a design in which an upper surface side warp passes over one upper surface side weft and then passes under one upper surface side weft. Even by this example, a fabric excellent in surface property, fiber supporting property, rigidity, air permeability and water drainage property and having an upper surface side surface densified by an increase in the count can be obtained.

Example 5

Figure 5:
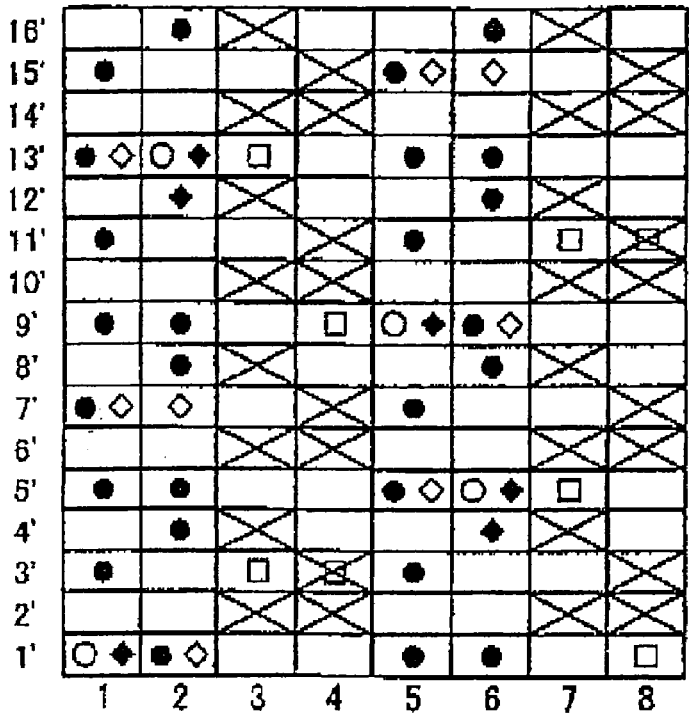
FIG. 5 is a design diagram of an industrial two-layer fabric according to Example 5 of the present invention.

A still further example of the fabric according to the present invention is illustrated in FIG. 5. Pairs of warp binding yarns and pairs of an upper surface side warp and a lower surface side warp are arranged at a ratio of 2:2. By this arrangement, warp binding yarns have, on the upper surface side surface, two warp complete designs, that is, a warp complete design obtained by repeating a design in which it passes over one upper surface side weft and then passes under one upper surface side weft and a warp complete design obtained by repeating a design in which it passes over two upper surface side wefts and then passes under two upper surface side wefts. Upper surface side warps also have similar two upper surface side warp complete designs. It is thus possible to form a fabric with warp binding yarns having two upper surface side warp complete designs. Even by this example, a fabric excellent in surface property, fiber supporting property, rigidity, air permeability and water drainage property and having an upper surface side surface densified by an increase in the count can be obtained.

Example 6

Figure 6:
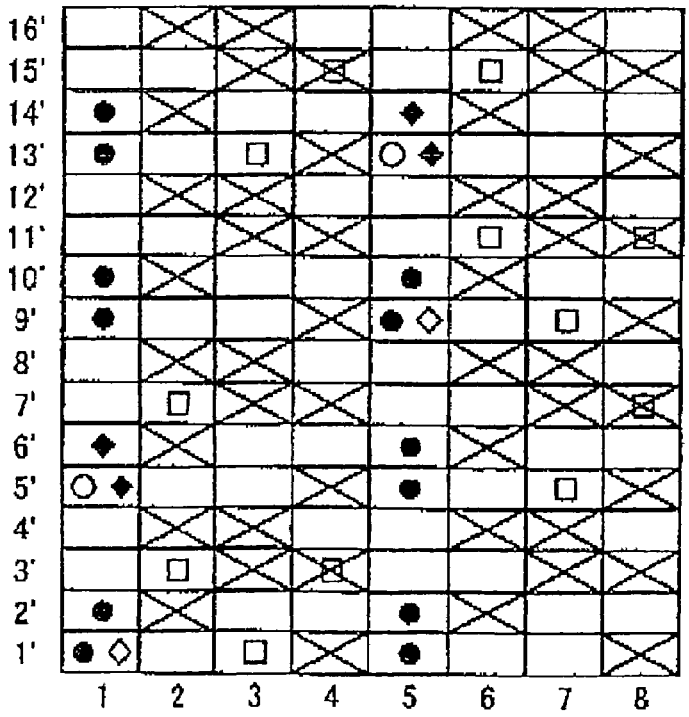
FIG. 6 is a design diagram of an industrial two-layer fabric according to Example 6 of the present invention.

A still further example of the fabric according to the present invention is illustrated in FIG. 6. The fabric of this example is similar to that of Example 2 except for the change of the lower surface side fabric design. In the lower surface side fabric design in Examples 1 to 5, a lower surface side weft passes over two warps and then passes under six warps to form a long crimp corresponding to six warps on the lower surface side surface. In this example, however, a lower surface side weft passes over one warp, passes under one warp, passes over one warp and then passes under five warps. Since a weft long crimp is formed on the lower surface side surface, the resulting fabric has excellent wear resistance. In addition, the lower surface side weft is strongly woven from the lower surface side by two adjacent warps so that the resulting fabric is also excellent in rigidity of the fabric and binding power. The lower surface side fabric design is thus not particularly limited and any design can be adopted.

Example 7

Figure 7:
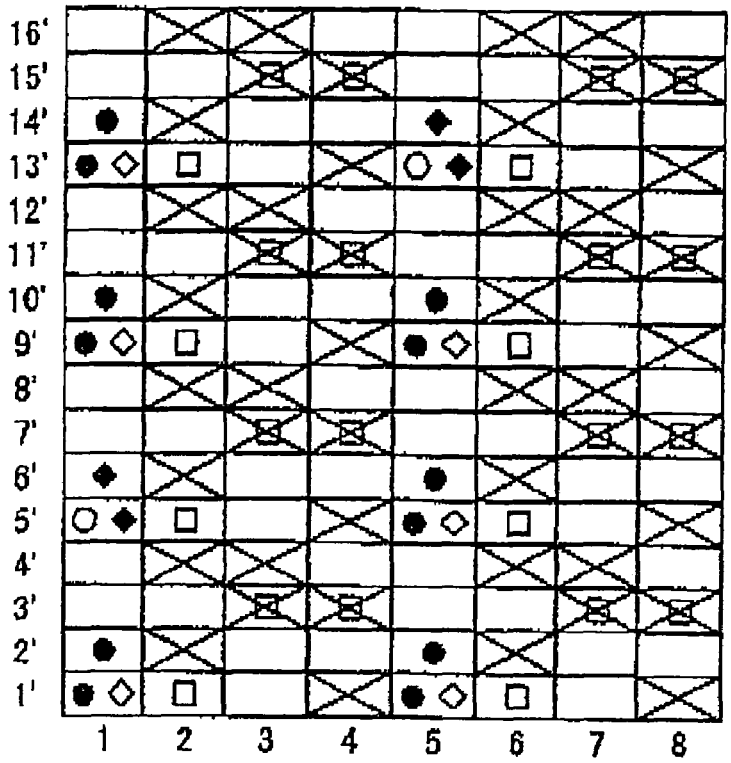
FIG. 7 is a design diagram of an industrial two-layer fabric obtained in Example 7 of the present invention.

A still further example of the fabric according to the present invention is illustrated in FIG. 7 and it is similar to that of FIG. 6 except for the lower surface side fabric design. In this example, a complete design obtained by repeating a design in which two adjacent warps forming the lower surface side surface pass over one lower surface side weft and then pass under one lower surface side weft is employed as the lower surface side fabric design. The fabric having such a design is able to have improved rigidity and binding strength. The fabric can be thinned by using a warp binding yarn having a smaller diameter.

Example 8

Figure 8:
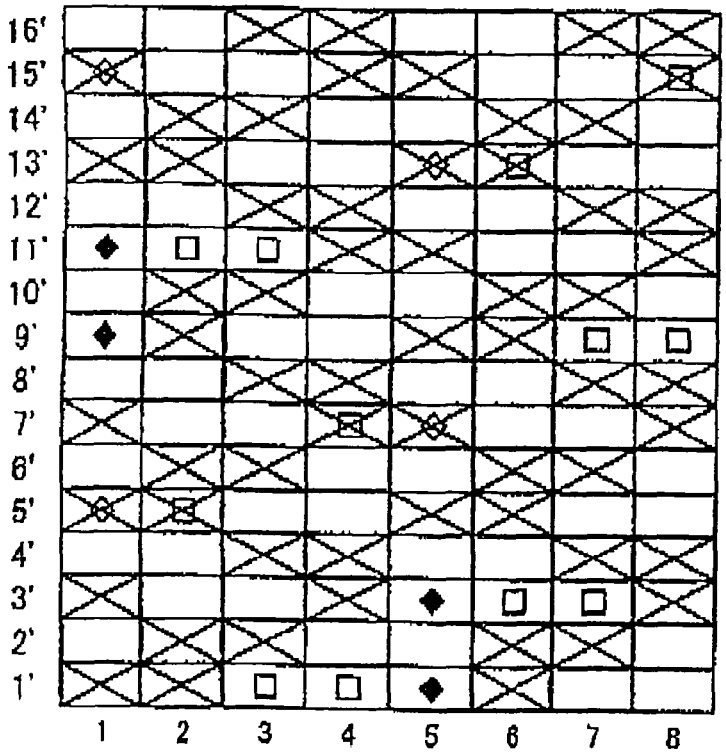
FIG. 8 is a design diagram of an industrial two-layer fabric according to Example 8 of the present invention.

A still further example of the fabric according to the present invention is illustrated in FIG. 8 and in this example, pairs of a warp binding yarn and an upper surface side warp are arranged. The fabrics obtained in Examples 1 to 7 are each composed of pairs of warp binding yarns and pairs of an upper surface side warp and a lower surface side warp. In this Example, however, a warp binding yarn and an upper surface side warp form a pair and they cooperatively form, on the upper surface side surface, a warp complete design corresponding to one upper surface side warp, and on the lower surface side surface, a warp complete design corresponding to one lower surface side warp. FIGS. 14A and 14B are cross-sectional views taken along warps 1 and 2 of this Example respectively.

Warp 1 and Warp 5 are each a pair of a warp binding yarn and an upper surface side warp. As is apparent from the cross-sectional view of Warp binding yarn 1 of FIG. 14A, a design in which an upper surface side warp forming a pair with a warp binding yarn passes over one upper surface side weft and then passes under one upper surface side weft is repeated six times, followed by a design in which it passes between four upper and lower surface side wefts. In a portion where the upper surface side warp does not appear, the warp binding yarn appears on the upper surface side, thereby forming a portion of the upper surface side surface design. The warp binding yarn has a design in which it passes over one upper surface side weft, passes under one upper surface side weft, passes over one upper surface side weft, passes between three upper and lower surface side wefts, passes under one lower surface side weft, passes between five upper and lower surface side wefts, passes under one lower surface side weft and then passes between three upper and lower surface side wefts. These designs are used in combination and as a result, a warp complete design obtained by repeating a design in which warp passes over one upper surface side weft and then passes under one upper surface side weft can be formed on the upper surface side surface. On the lower surface side surface, only warp binding yarn 1 of Warp 1 forms the lower surface side surface design and the upper surface side warp does not appear on the lower surface side surface. In Warps 2, 3 and 4, an upper surface side warp and a lower surface side warp form a pair so that the upper surface side warps 2, 3 and 4 form the upper surface side surface design, while the lower surface side warps 2, 3 and 4 form the lower surface side surface design.

Even a two layer fabric in which pairs of a warp binding yarn and an upper surface side warp are arranged is able to have excellent surface property, fiber supporting property, rigidity, air permeability and water drainage property and have an upper surface side surface densified by an increase in the count.

Example 9

Figure 9:
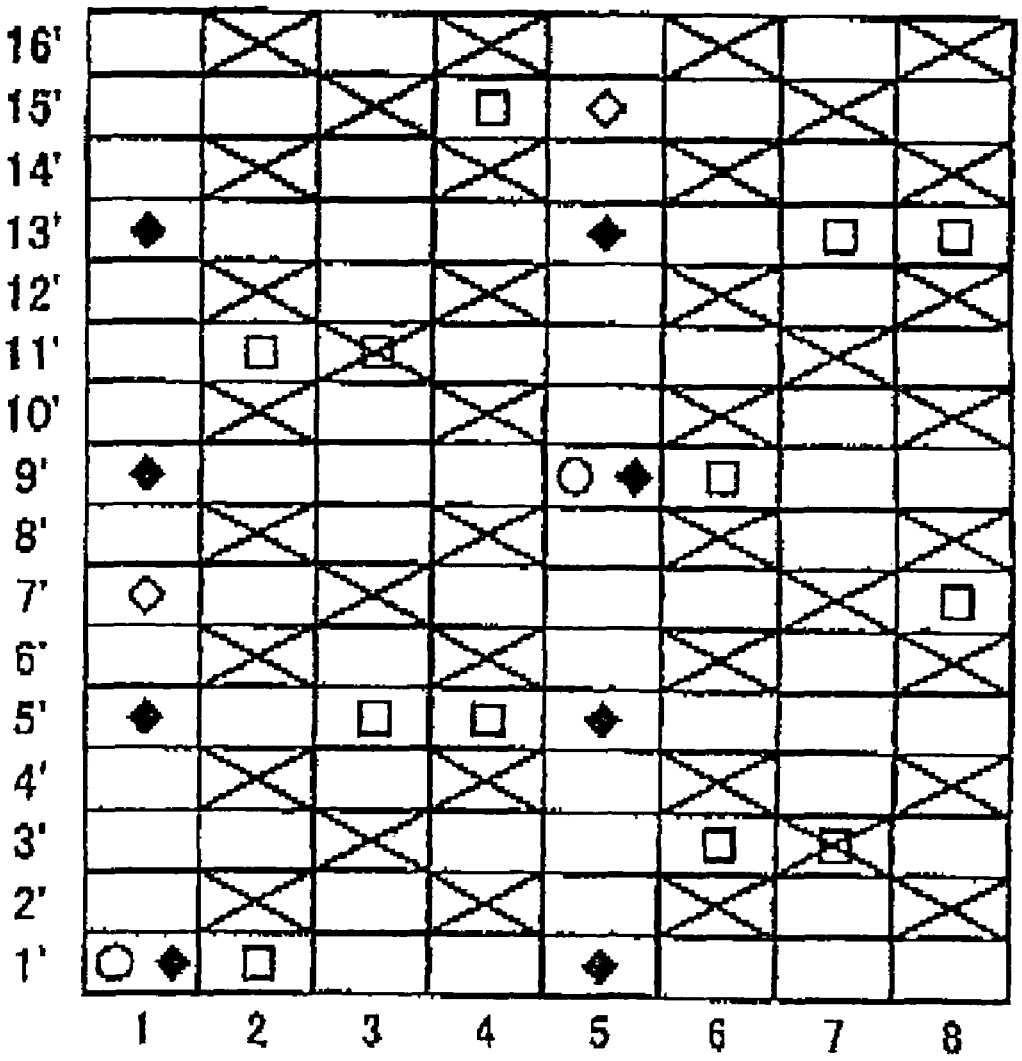
FIG. 9 is a design diagram of an industrial two-layer fabric according to Example 9 of the present invention.

A still further example of the fabric according to the present invention is illustrated in FIG. 9 and in this example, pairs of a warp binding yarn and a lower surface side warp are arranged. The fabric obtained in Example 8 has pairs of a warp binding yarn and an upper surface side warp. In this example, on the other hand, a warp binding yarn and a lower surface side warp form a pair. On the upper surface side surface, a warp complete design corresponding to one upper surface side warp is formed, while on the lower surface side surface, they cooperatively form a warp complete design corresponding to one lower surface side warp. FIGS. 15A and 15B are cross-sectional views taken along Warps 1 and 2 of this example respectively.

Warp 1 and Warp 5 are each a pair of a warp binding yarn and a lower surface side warp. As is apparent from the cross-sectional view of Warp binding yarn 1 of FIG. 15A, a warp binding yarn passes over one upper surface side weft, passes under three upper surface side wefts, passes over one upper surface side weft, passes under three upper surface side wefts, passes over one upper surface side weft, passes under three upper surface side wefts, passes over one upper surface side weft and then passes under one lower surface side weft.

The lower surface side warp has a design in which it passes under one lower surface side weft and passes over the other lower surface side wefts. The lower surface side warp and warp binding yarn cooperatively form, on the lower surface side surface, a design in which either one passes under one lower surface side weft, passes over two lower surface side wefts, passes under one lower surface side weft and then passes over four lower surface side wefts.

In Warps 2, 3 and 4, an upper surface side warp and a lower surface side warp form a pair so that upper surface side warps 2, 3 and 4 form the upper surface side surface design, while lower surface side warps 2, 3 and 4 form the lower surface side surface design.

Thus, even a two-layer fabric having pairs of a warp binding yarn and a lower surface side warp is able to have excellent surface property, fiber supporting property, rigidity, air permeability, and water drainage property and have an upper surface side surface densified by an increase in the count.

Example 10

Figure 10:
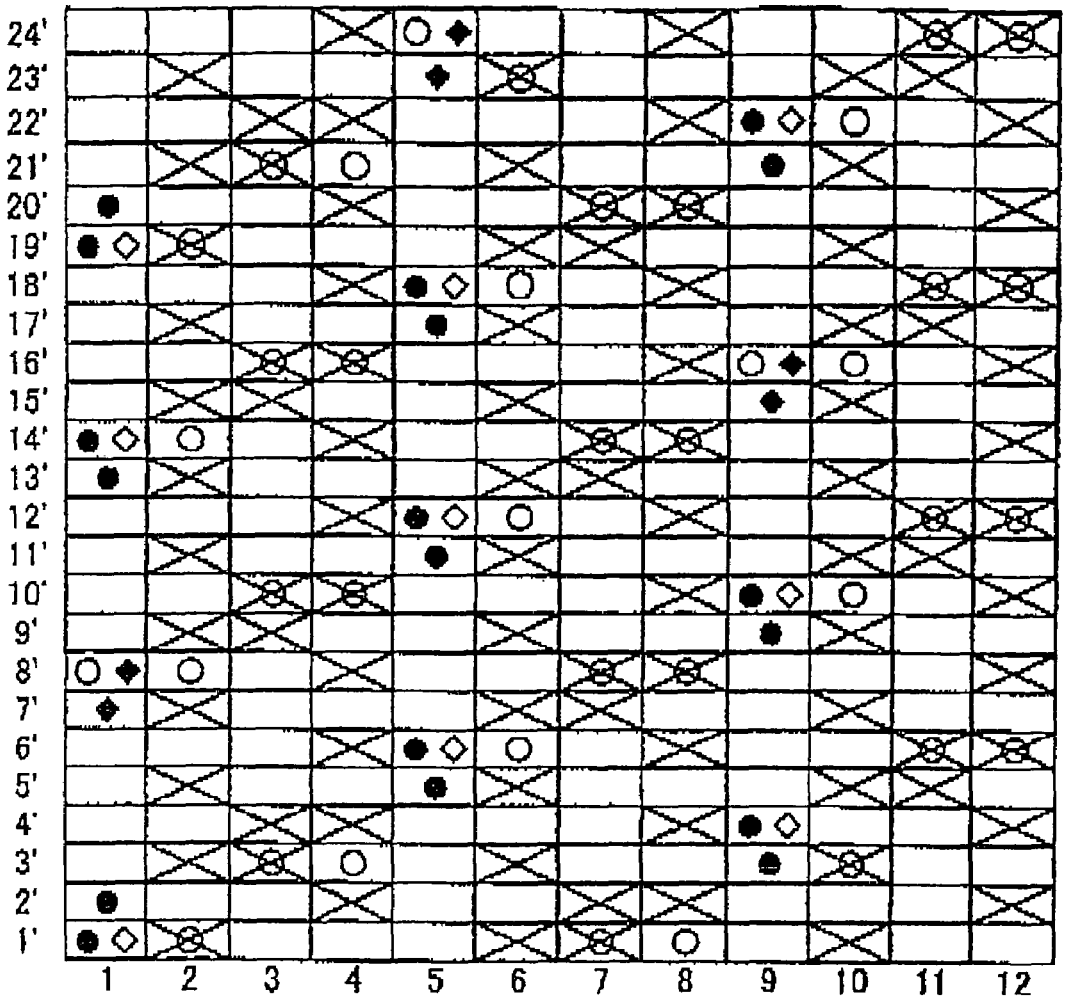
FIG. 10 is a design diagram of an industrial two-layer fabric according to Example 10 of the present invention.

A still further example of the fabric according to the present invention is illustrated in FIG. 10. It is a 24-shaft two-layer fabric obtained by alternately arranging, on the upper surface side surface, two warp complete designs, that is, a warp complete design obtained by repeating a design in which a warp passes over one upper surface side weft and then passes under one upper surface side weft and a warp complete design obtained by repeating a design in which a warp passes over two upper surface side wefts and then passes under four upper surface side wefts. Two warp binding yarns constitute a pair and this pair and a pair of an upper surface side warp and a lower surface side warp are arranged at a ratio of 1:3. The pair of warp binding yarns has, on the upper surface side surface, a warp complete design obtained by repeating a design in which a warp binding yarn passes over two upper surface side wefts and then passes under four upper surface side wefts. As in this example, it is possible to increase the number of shafts. Similar to the other examples, a fabric excellent in surface property, fiber supporting property, rigidity, air permeability, and water drainage property and having an upper surface side surface densified by an increase in the count can be obtained.

Example 11

Figure 11:
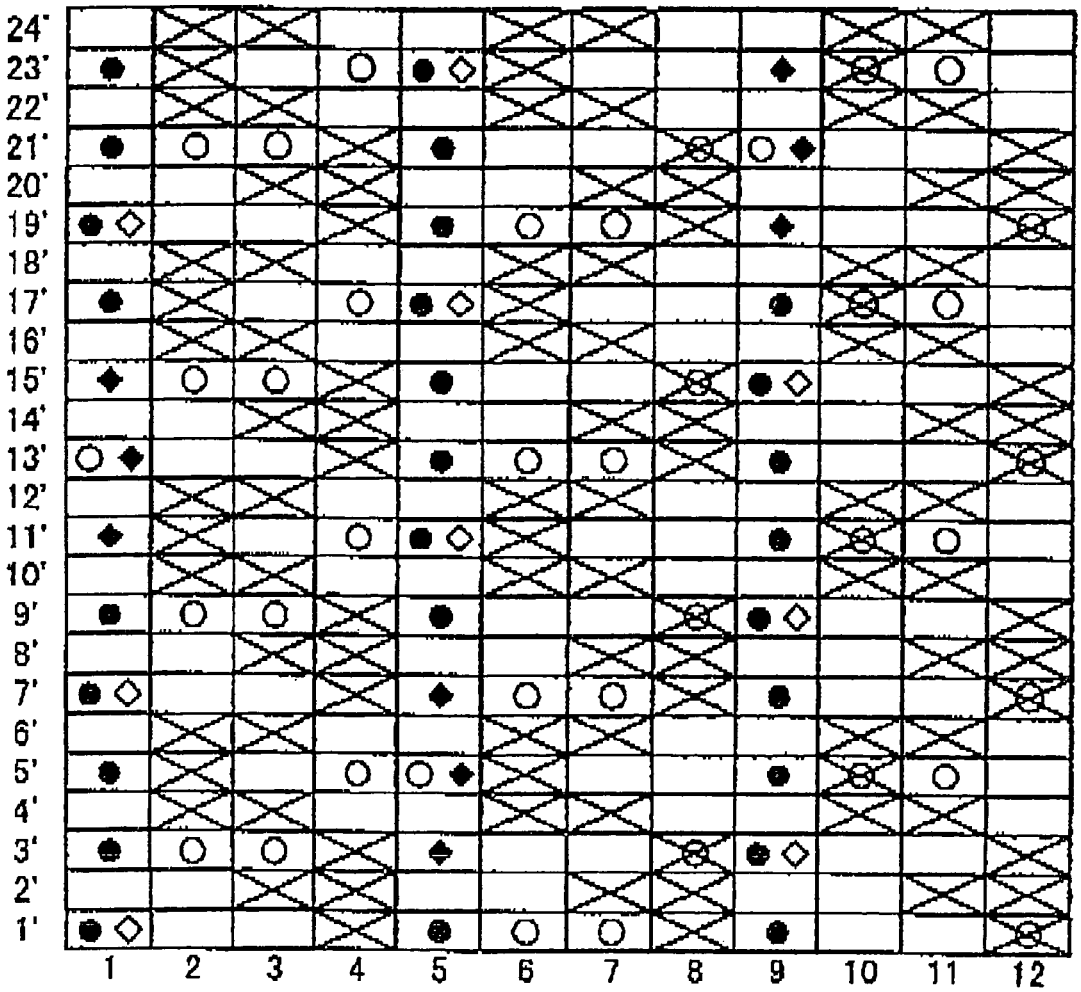
FIG. 11 is a design diagram of an industrial two-layer fabric according to Example 11 of the present invention.

A still further example of the fabric according to the present invention is illustrated in FIG. 11. It is a 24-shaft two-layer fabric obtained by alternately arranging, on the upper surface side surface, two warp complete designs, that is, a warp complete design obtained by repeating a design in which a warp passes over one upper surface side weft and then passes under one upper surface side weft and a warp complete design obtained by repeating a design in which a warp passes over three upper surface side wefts and then passes under three upper surface side wefts. Two warp binding yarns constitute a pair. The fabric obtained in this example is similar to that obtained in Example 10 except for the design of a warp binding yarn. The pair of warp binding yarns in this example has a warp complete design obtained by repeating, on the upper surface side surface, a design in which a warp binding yarn passes over one upper surface side weft and then passes under one upper surface side weft. Another warp complete design constituting the upper surface side surface is obtained by repeating a design in which a warp passes over three upper surface side wefts and then passes under three upper surface side wefts. Similar to the other examples, a fabric excellent in surface property, fiber supporting property, rigidity, air permeability, and water drainage property and having an upper surface side surface densified by an increase in the count can be obtained in this example.

Example 12

Figure 12:
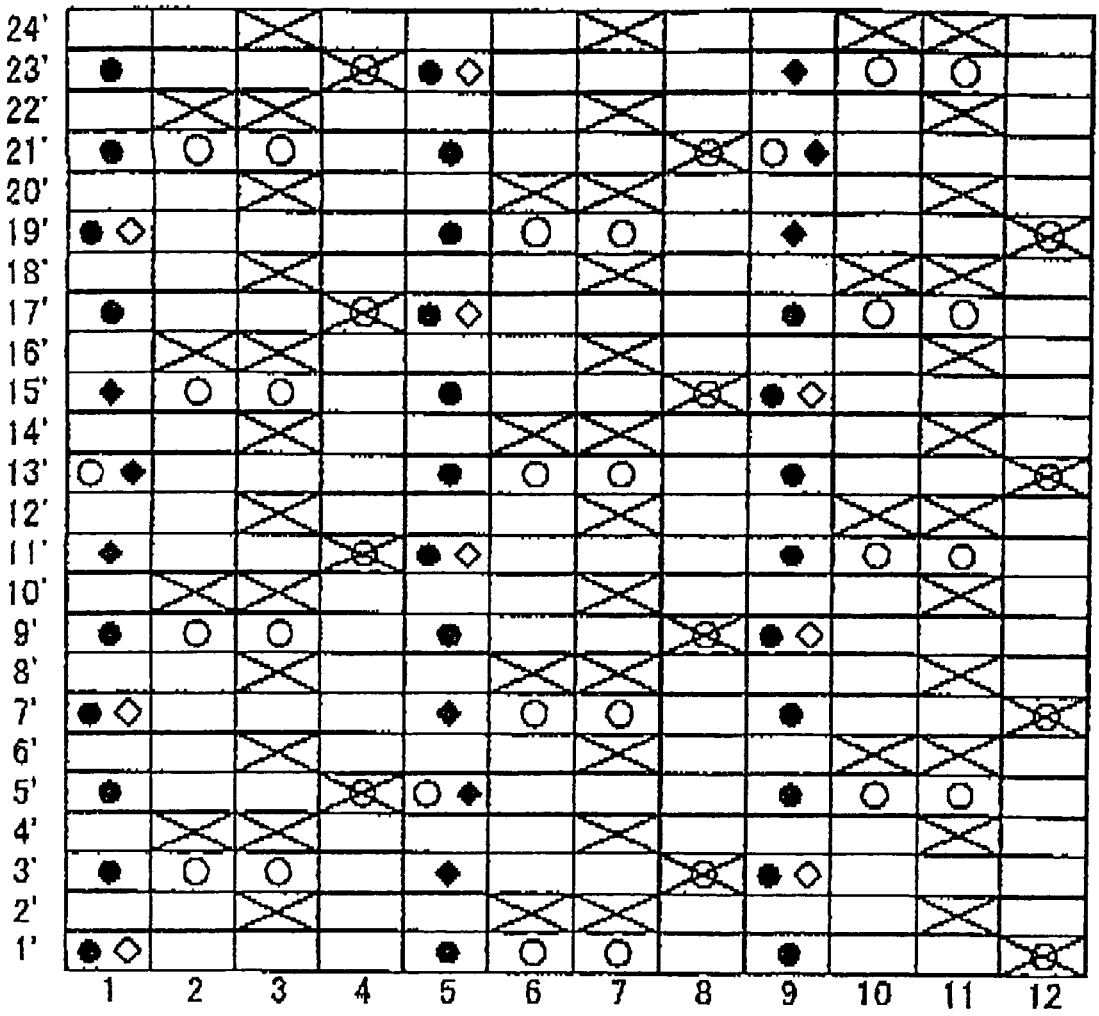
FIG. 12 is a design diagram of an industrial two-layer fabric according to Example 12 of the present invention.

A still further example of the fabric according to the present invention is illustrated in FIG. 12. It is a 24-shaft two-layer fabric obtained by alternately arranging, on the upper surface side surface, two warp complete designs, that is, a warp complete design obtained by repeating a design in which a warp passes over one upper surface side weft and then passes under one upper surface side weft and a warp complete design obtained by repeating a design in which a warp passes over one upper surface side weft and then passes under five upper surface side wefts. Two warp binding yarns constitute a pair. The fabric obtained in this example is similar to that obtained in Example 11 except for the upper surface side surface design. In this example, one of the warp binding yarns on the upper surface side has a warp complete design obtained by repeating a design in which a warp binding yarn passes over one upper surface side weft and then passes under five upper surface side wefts. Compared with the fabric obtained in Example 11, the fabric obtained in this example has less knuckles and lower diagonal rigidity, but it is suited for use as an industrial fabric because a plain weave warp complete design is arranged alternately. In addition, similar to the fabrics obtained in the other examples, the fabric obtained in this example has excellent surface property, fiber supporting property, rigidity, air permeability, and water drainage property and has an upper surface side surface densified by an increase in the count.

The industrial fabrics according to the present invention can satisfy the properties required for them such as surface property, rigidity, running stability, fiber supporting property and water drainage property so that they are employed as an industrial fabric, for example, for papermaking.

Although only some exemplary embodiments of this invention have been described in detail above, those skilled in the art will readily appreciated that many modifications are possible in the exemplary embodiments without materially departing from the novel teachings and advantages of this invention. Accordingly, all such modifications are intended to be included within the scope of this invention.

The disclosure of Japanese Patent Application No. 2004-333080 filed Nov. 17, 2005 including specification, drawings and claims is incorporated herein by reference in its entirety.

What is claimed is:

1. An industrial two-layer fabric comprising pairs of an upper surface side warp and a lower surface side warp arranged vertically, upper surface side wefts, lower surface side wefts, and warp binding yarns woven with the wefts to form a portion of an upper surface side surface design and a portion of a lower surface side surface design, wherein:

the industrial two-layer fabric has an upper surface side surface formed by alternately arranging (a) a warp complete design made of a design in which one warp passes over one upper surface side weft and then passes under one upper surface side weft, and any one of the following warp complete designs (b) to (i): (b) a warp complete design made of a design in which one warp passes over two upper surface side wefts and then passes under two upper surface side wefts, (c) a warp complete design made of a design in which one warp passes over one upper surface side weft and then passes under three upper surface side wefts, (d) a warp complete design made of a design in which one warp passes over three upper surface side wefts and then passes under one upper surface side weft, (e) a warp complete design made of a design in which one warp passes over three upper surface side wefts and then passes under three upper surface side wefts, (f) a warp complete design made of a design in which one warp passes over two upper surface side wefts and then passes under four upper surface side wefts, (g) a warp complete design made of a design in which one warp passes over four upper surface side wefts and then passes under two upper surface side wefts, (h) a warp complete design made of a design in which one warp passes over one upper surface side weft and then passes under five upper surface side wefts, and (i) a warp complete design made of a design in which one warp passes over five upper surface side wefts and then passes under one upper surface side weft.

2. The industrial two-layer fabric according to claim 1, wherein the complete design constituting the fabric is a 16-shaft one having 16 warps or a 24-shaft one having 24 warps.

3. The industrial two-layer fabric according to claim 1, wherein the upper surface side surface design is made of one or two weft complete designs.

4. The industrial two-layer fabric according to any one of claims 1 to 3, wherein the upper surface side warp and lower surface side warp of at least a pair of an upper surface side warp and a lower surface side warp are each the warp binding yarn woven with an upper surface side weft. and a lower surface side weft to form a portion of an upper surface side surface design and a portion of a lower surface side surface design; and on the upper surface side surface, warp binding yarns as a pair are woven with respective upper surface side wefts and cooperatively function as one warp constituting the upper surface side complete design.

5. The industrial two-layer fabric according to any one of claims 1 to 3, wherein at least one upper surface side warp is the warp binding yarn woven with an upper surface side weft and a lower surface side weft to form a portion of an upper surface side surface design and a portion of a lower surface side surface design, and in the pair of the warp binding yarn and a lower surface side warp, the warp binding yarn is woven with an upper surface side weft to serve as one warp constituting the upper surface side complete design on the upper surface side surface.

6. The industrial two-layer fabric according to any one of claims 1 to 3, wherein at least one lower surface side warp is the warp binding yarn woven with an upper surface side weft and a lower surface side weft to form a portion of an upper surface side surface design and a portion of a lower surface side surface design, and in the pair of the warp binding yarn and an upper surface side warp, the warp binding yarn and the upper surface side warp are woven with respective upper surface side wefts and cooperatively function as one warp constituting the upper surface side complete design on the upper surface side surface.

7. The industrial two-layer fabric, wherein in the pair of warp binding yarns as claimed in claim 4, one warp binding yarn is woven with an upper surface side weft, below which the other warp binding yarn is woven with at least one lower surface side weft, and at the same time, the one warp binding yarn is woven with at least one lower surface side weft, over which the other warp binding yarn is woven with at least one upper surface side weft; and the warp binding yarns as a pair mutually complement the upper surface side surface design and lower surface side surface design each other.

8. An industrial two-layer fabric according to any one of claims 1 to 3, wherein in the lower surface side fabric, a lower surface side weft is simultaneously woven, from the lower surface side, by two adjacent lower surface side warps; a weft long crimp corresponding to a plurality of warps is formed on the lower surface side surface by adopting a design in which one lower surface side weft passes over two lower surface side warps and then passes under the plurality of warps; and by forming a portion where a lower surface side warp passes under a lower surface side weft alternately with right-hand and left-hand lower surface side warps which are adjacent to the lower surface side warp, the lower surface side warp is brought into contact with these two right-hand and left hand lower surface side warps alternately to form a zigzag arrangement design.

9. An industrial two-layer fabric according to any one of claims 1 to 3, wherein the fabric has on the upper surface side surface thereof a design in which an upper surface side weft and an auxiliary weft having a smaller diameter than the upper surface side weft are arranged alternately and the auxiliary yarn has a portion forming a long crimp which passes over a plurality of warps.

10. An industrial two-layer fabric according to any one of claims 1 to 3, wherein the number of upper surface side wefts is from 1 to 2 times as much as the number of lower surface side wefts.

* * * * *